US005518353A

United States Patent [19]

Pettersen et al.

[11] Patent Number: 5,518,353

[45] Date of Patent: May 21, 1996

[54] ARRANGEMENT IN AN UNLOADING SYSTEM

[75] Inventors: Jan E. Pettersen, Porsgrunn; Walter Nilsen, Vestbysvingen 14, N-3074 Skoger, both of Norway

[73] Assignee: Walter Nilsen, Norway

[21] Appl. No.: 170,196

[22] PCT Filed: Jun. 26, 1992

[86] PCT No.: PCT/NO92/00115

§ 371 Date: Nov. 21, 1994

§ 102(e) Date: Nov. 21, 1994

[87] PCT Pub. No.: WO93/00253

PCT Pub. Date: Jan. 7, 1993

[30] Foreign Application Priority Data

Jun. 27, 1991 [NO] Norway ..... 912538

[51] Int. Cl.[6] ..... B63B 27/22

[52] U.S. Cl. ..... 414/142.3; 198/516; 198/519; 414/142.9

[58] Field of Search ..... 198/511, 516, 198/519, 520, 522; 414/142.9, 142.3, 142.4

[56] References Cited

U.S. PATENT DOCUMENTS

| | | | |
|---|---|---|---|
| 1,427,091 | 8/1922 | Case . | |
| 2,505,982 | 5/1950 | Meissner . | |
| 3,414,144 | 12/1968 | Lassing | 414/142.4 |
| 3,489,296 | 1/1970 | Snow, III . | |
| 4,242,026 | 12/1980 | Vaughan et al. | 414/142.3 |

FOREIGN PATENT DOCUMENTS

| | | |
|---|---|---|
| 150894 | 7/1987 | Denmark . |
| 235585 | 9/1987 | European Pat. Off. . |
| 387039 | 12/1923 | Germany . |
| 565659 | 12/1932 | Germany . |
| 414903 | 8/1980 | Sweden . |
| 438648 | 4/1985 | Sweden . |
| 1567877 | 5/1980 | United Kingdom . |

*Primary Examiner*—William E. Terrell
*Assistant Examiner*—Janice L. Krizek
*Attorney, Agent, or Firm*—Hedman, Gibson & Costigan

[57] ABSTRACT

An arrangement for unloading bulk material (1*a*) from holds (2*a*–2*e*) in a transport vessel (1), comprising a belt conveyor (3*a*, 3*b*, 3*t*) extending in the longitudinal direction of the ship close to the bottom (9) thereof, the belt conveyor supporting inclined, downwardly extending guiding plates (8) on each side of the conveyor (3*a*, 3*b*), a scraper unit (10) in each hold (2*a*, 2*e*) bringing bulk material (1*a*) to the area of the belt conveyor (3*a*, 3*b*, 3*t*), and lifting devices (5*a*, 5*b*) co-operating with the belt conveyor (3*a*, 3*b*, 3*t*) for lifting the material to a common outfeed device for bringing the material ashore. The belt conveyor (3*a*, 3*b*) is arranged between vertical supports (6) which support inclined, downwardly extending guiding plates (8) on each side of the conveyor (3*a*, 3*b*). The scraper unit (10) comprises a bent lower portion (10*a*, 10*b*) corresponding substantially to the shape of the guiding plates (8) and the adjoining ship bottom portion (9).

8 Claims, 5 Drawing Sheets

ARRANGEMENT IN AN UNLOADING SYSTEM

FIELD OF THE INVENTION

The present invention relates to an arrangement in an unloading system, especially for unloading bulk material from holds in a transport vessel, said system comprising a belt conveyor extending substantially in the longitudinal direction of the ship close to the bottom thereof, a scraper unit in each hold bringing bulk material to the area of the belt conveyor, as well as one or more lifting means co-operating with said belt conveyor for lifting the masses to a common outfeed device for bringing said masses ashore.

PRIOR ART

In connection with unloading of bulk material from a ship, there are often used land based unloading devices, for example a conveyor which is suspended from a crane arm, and which can be designated as a vertical conveyor, and which is intended to transport bulk material up from the hold. Such land based vertical conveyors which can be displaced to the various parts of the hold, are however relatively expensive and will rarely be present in all harbours in which unloading of bulk material is intended.

Another solution to unloading the hold of a transport vessel resides in installation of affixed unloading devices in the vessel itself. Such unloading devices which are mounted in the hold itself, are generally very complicated and very often suffering from the disadvantage that they cannot be used for complete removal of all bulk material. This is especially the case in connection with unloading of for example soya derivatives, cement, gypsum powder or aluminum oxide.

Solutions to the unloading problems of the above mentioned type are discussed in for example SE 419 737, GB 1 567 877 and GB 1 538 088.

OBJECT OF THE INVENTION

The task underlying the present invention is to provide a simple and effective unloading system, which entails that the cargo vessels to which the unloading system is to be adapted, should not only be used for transport of bulk material, for example gypsum or similar bulk material, but also for transport of usual, piece goods and similar.

In other words, it is aimed for providing an unloading system entailing that the vessel does not need to be a special ship which comprises especially adapted hold walls or bottoms, or comprises especially adapted loading devices making it difficult to use the vessel for anything else than bulk material.

In other words, the present system is especially developed for being mounted substantially in general bulk cargo ships, but possibly also usual piece goods ships, thereby providing excellent adaptabilities and very small requirements as regards changes in the structure of the ship, the elements included in the system facilitating a simple and quick mounting, and the finished installation resulting in relatively small losses in volume.

DISCUSSION OF THE PRESENT INVENTION

In an unloading system of the type as stated in the preamble, the above stated problem is solved in that the belt conveyor is mounted between vertical supports supporting inclined downwardly extending guiding plates on the side of the conveyor, and that said scraper unit comprises a bent lower portion corresponding substantially to the shape of said guiding plates and the ajoining ship bottom portion. Appropriately, there are in the area of the supports along the belt conveyor provided a series of hoppers serving to dose the masses from a scraper unit and on to the belt conveyor.

An appropriate embodiment of the system according to the present invention is the fact that there are provided a first belt conveyor extending longitudinally along the ship through a first number of holds towards one of the central transverse bulkheads of the ship, as well as a second belt conveyor extending longitudinally along the ship in opposite direction through a second number of holds towards said central transverse bulkhead, and that at each side of the central transverse bulkhead there are provided two parallelly arranged lifting means, especially cup conveyors co-operating with a respective belt conveyor for lifting said masses up to the common outfeed device for bringing said masses ashore.

These longitudinally extending belt conveyors will cater for the unloading of the central holds, and since the belt conveyors are in the central portion of the ship, and thereby are appropriately provided with guiding plates on each side, the corresponding scraper units which co-operate with said belt transporter will comprise two lower bent portions which substantially symmetrically about the central axis of the groove, correspond to the shape of the guiding plates on both sides of the groove.

In connection with the aft or front holds of the ship, if these holds normally do not have parallel ship sides, it is appropriate in the area of a transverse ship bulkhead to provide one or more transversly to the ship extending belt conveyor, such a belt conveyor being mounted in a groove having inclined guiding plates only on that side which faces away from the transverse bulkhead wall, a longitudinally along the ship extending scraper unit co-operating with the belt conveyor only comprising one lower bent portion. An effective utilization of the system, especially in a front or aft hold is achieved if the scraper unit is suspended in a divided transversly to the ship extending driving beam, which means that the scraper unit can be raised completely up under the deck during loading, i.e. in parked position, whereas during unloading the scraper unit may be lowered and displaced sideways underneath the side tanks across the complete bottom width of said holds.

In order to organize the unloading from the front and/or aft hold, one or more transversly extending belt conveyors being supplied with mass from a respective longitudinally extending scraper unit are adapted to communicate with the longitudinally extending belt conveyor which in turn brings the masses to the common outfeed device.

Further advantages and features of the present invention will appear from the following description taken in conjunction with the appended drawings.

BRIEF DISCLOSURE OF THE DRAWINGS

DISCLOSURE OF EMBODIMENTS

Figure 1:
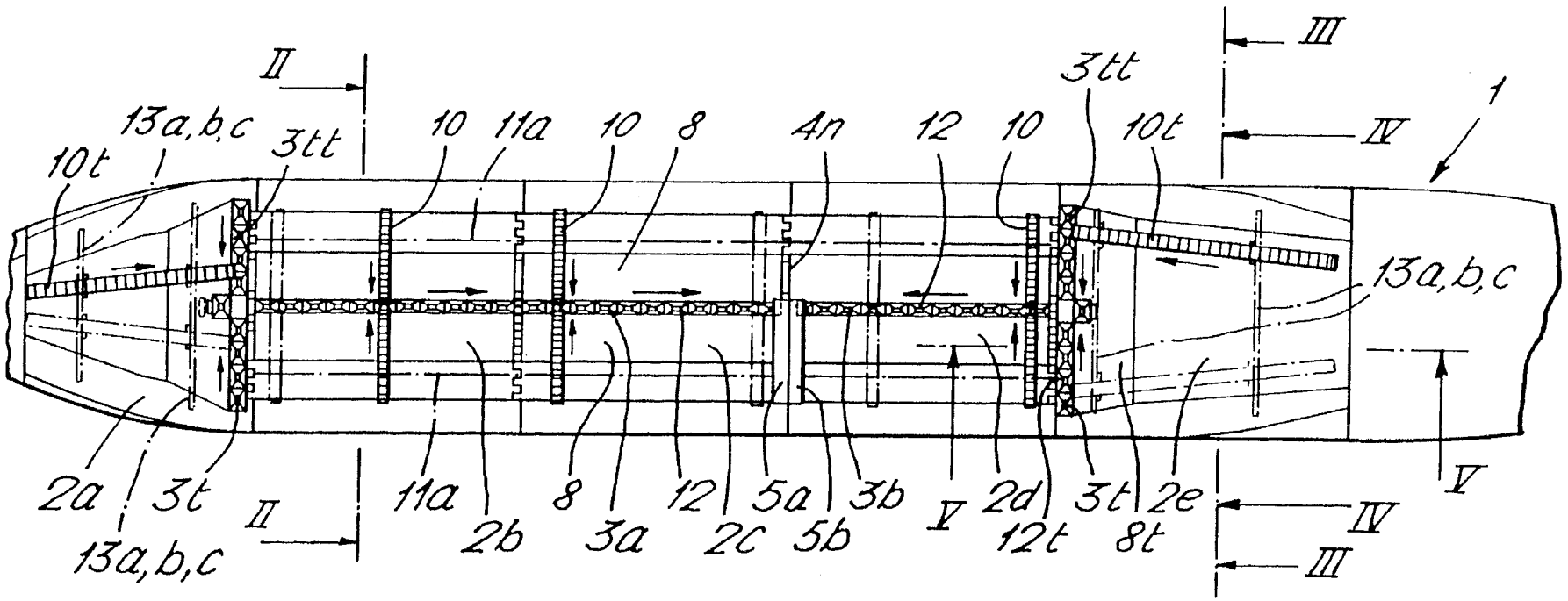
FIG. 1 is a diagramatical view as seen from above of a transport vessel wherein a non-limiting embodiment of the invention is included.

In FIG. 1 which schematically illustrates a top view of a bulk vessel, the latter is generally designated by reference numeral 1, said vessel comprising a plurality of holds 2*a*, 2*b*, 2*c*, 2*d* and 2*e*, which can be used for the transportation of bulk material, for example gypsum or similar bulk material 1*a*, but which can also be used for usual piece goods. In other words it is here a token about a bulk vessel or transport vessel 1 which originally could have been built for usual piece goods, i.e. without especially adapted holds, but which at an appropriate stage can be rebuilt for comprising the unloading system provided by the present invention.

In FIG. 1 as well as in the other Figures there is consequently illustrated an embodiment of an unloading system comprising elements which are adapted for automatic unloading of loose-masses in a bulk ship, and which as such are mounted permanently in the ship, but which are designed so as to easily be retracted towards the ship side, possibly be subjected to a simple demounting for thereby providing loading space for usual piece goods.

Figure 2:
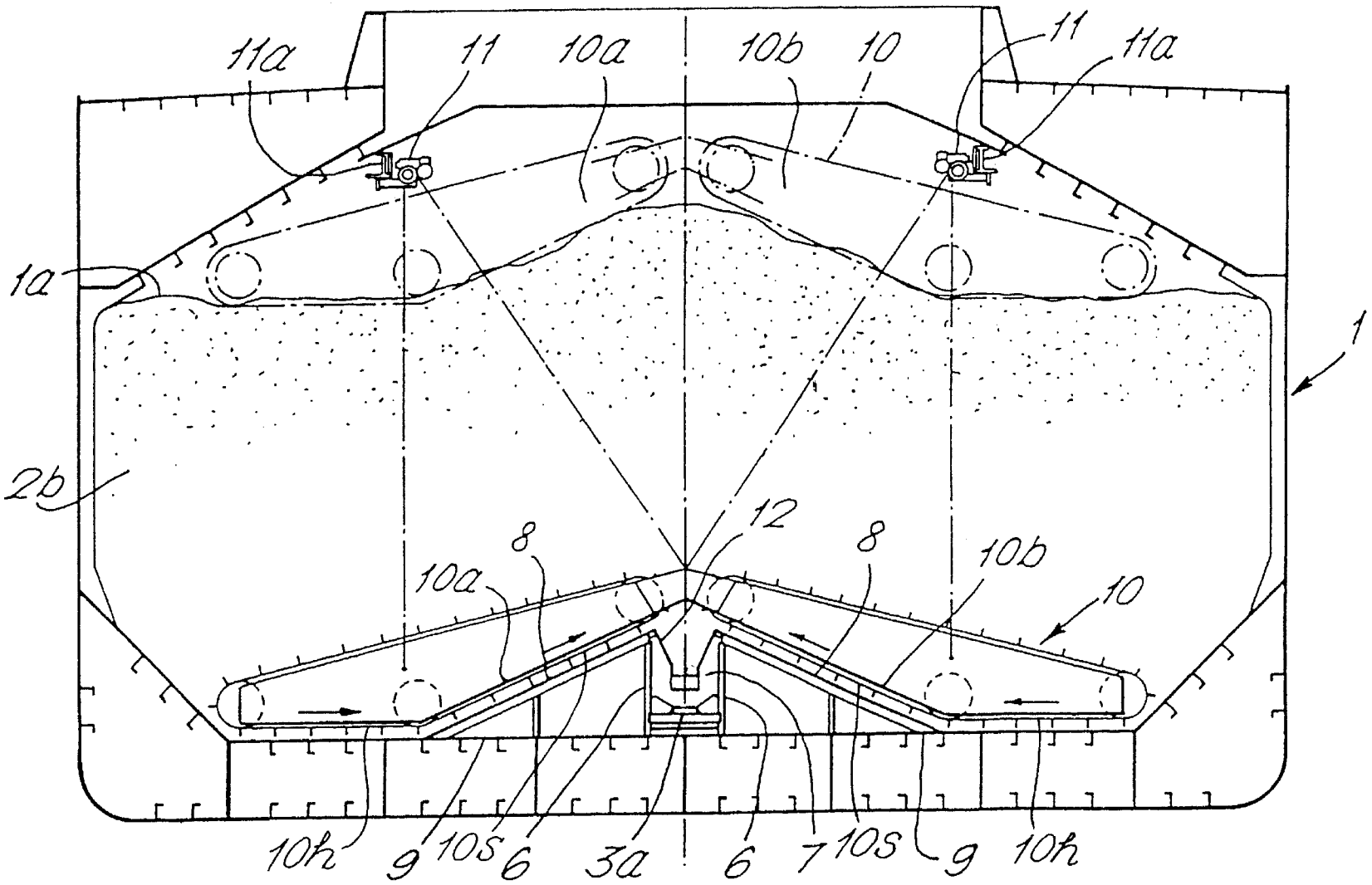
FIG. 2 illustrates on a larger scale a section taken along the line II—II in FIG. 1.

As appearing from FIG. 1 and especially from FIG. 2 a first embodiment of the invention comprises a first belt conveyor 3*a* extending longitudinally along the ship through a first number of holds, namely the holds 2*b* and 2*c*, towards one of the central transverse bulkheads 4*n*, as well as a second belt conveyor 3*b* which also extends longitudinally along the ship, but in opposite direction through a second number of holds, here the hold 2*d* and towards said central transverse bulkhead 4*n*. On each side of the central transverse bulkhead 4*n* there are provided two parallelly arranged lifting means, especially two cup conveyors 5*a* and 5*b*, respectively, which co-operate with a separate belt conveyor 3*a* and 3*b*, respectively, for lifting the masses 1*a* up to a common, not illustrated, outfeed device for bringing the masses ashore. Such a common outfeed device can for example comprise a pivotable arm having an inner belt conveyor, for example of the type disclosed in applicant's international application PCT/N090/00050 (WO 90/12732).

As especially appearing from FIG. 2 the belt conveyor 3*a* appears between vertical supports 6 which therebetween define some sort of a guiding path 7 for the belt conveyor 3*a*, said vertical supports 6 at their tops supporting or merging into inclined downwardly extending guiding plates 8, for at their outer edge portions to abut against the bottom 9 of the hold 2*b*. In FIG. 2 there is also illustrated a scraper unit which generally is designated By reference numeral 10, said FIG. 2 also illustrating the scraper unit 10 in a first lower scraping position drawn with solid lines, as well as an upper scraping position drawn with dash-dotted lines.

Because the above described belt conveyors 3*a* and 3*b* reside in a separate guiding path 7, and because the respective guiding paths 7 are located along the central axis of the ship, and because the grooves are provided with guiding plates 8 on each side, the scraping units 10 residing in the holds 2*b*, 2*c* and 2*d*, respectively, will be provided with two lower bent portions 10*a* and 10*b*, respectively, which substantially symmetrically around the central axis of the ship correspond to the shape of the guiding plate 8 on each side of the guiding paths 7.

Preferably, the scraper units 10 are suspended in traverser carriages having a winch 11 which can be displaced along respective driving beams 11*a*.

Further, from FIG. 2 it appears that in the guiding path 7 in which the belt conveyors 3*a* and 3*b* reside, there is provided a respective row of hoppers 12 serving to dose the masses from said scraper unit 10 on the belt conveyors 3*a* and 3*b*.

Figure 3:
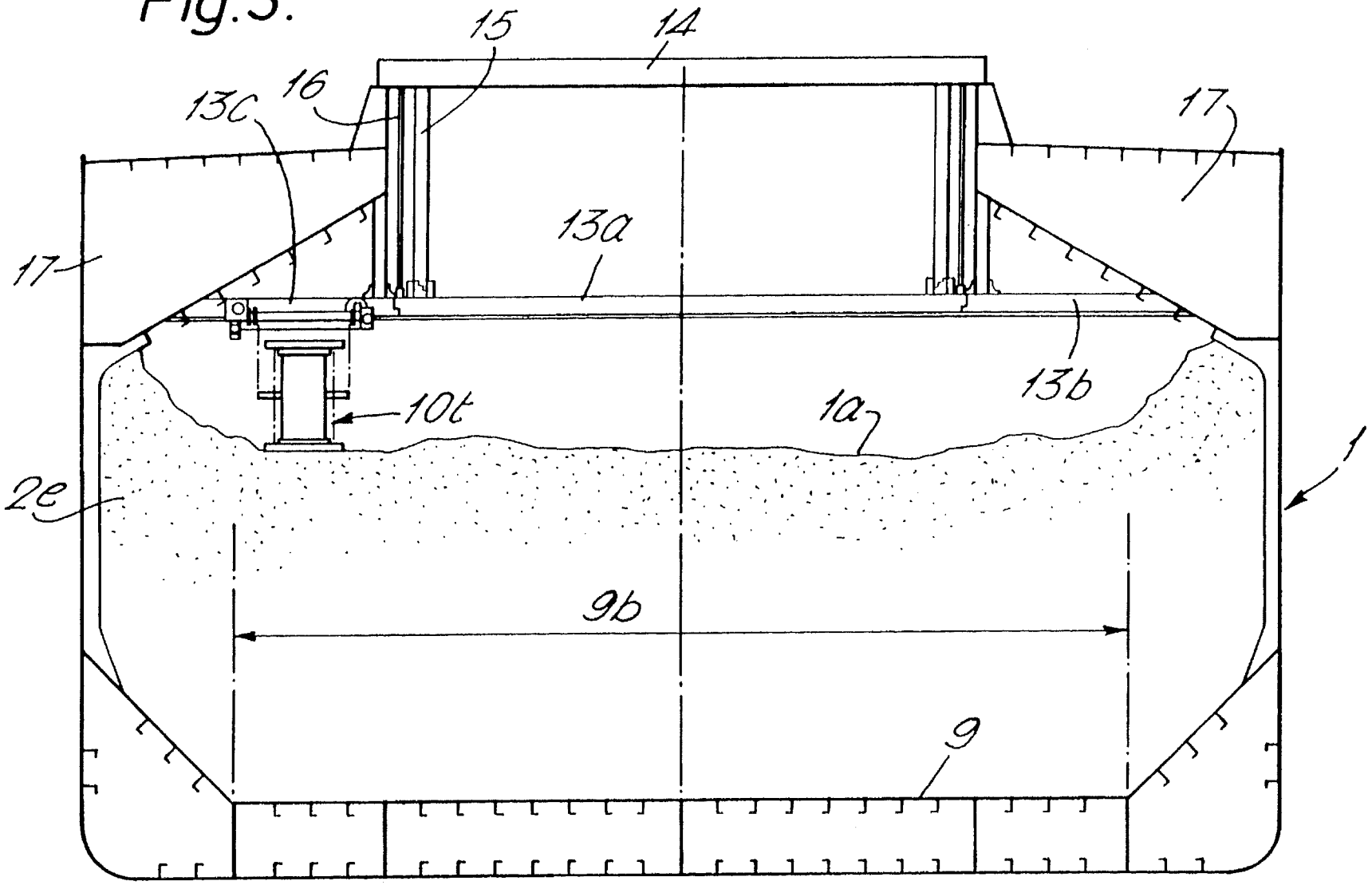
FIG. 3 illustrates a section taken along the line III—III in FIG. 1, and illustrates a scraper unit in operating position.
Figure 4:
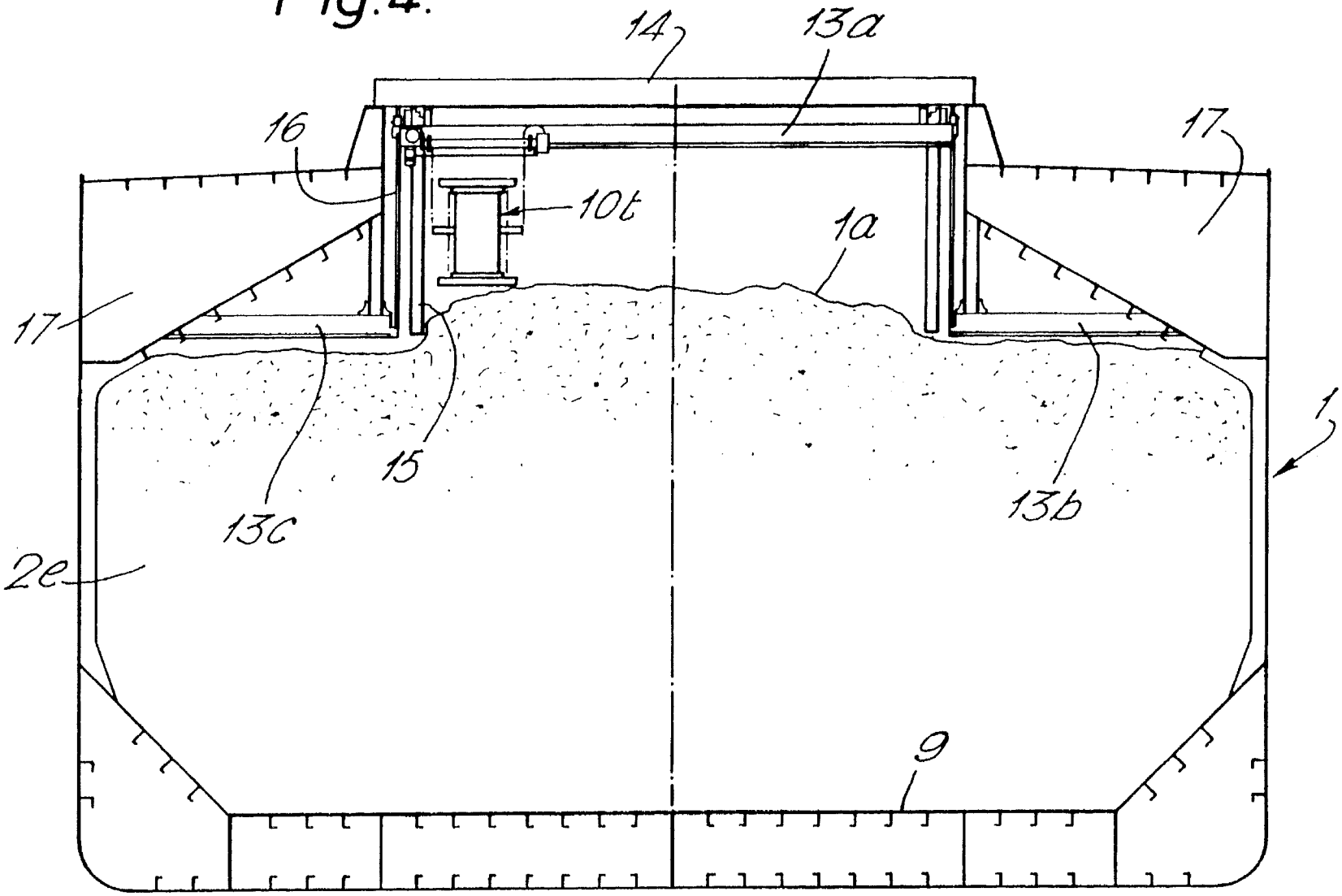
FIG. 4 is similarly to FIG. 3 a section taken along the line IV—IV in FIG. 1, and illustrates the scraper unit in a raised or parked position.
Figure 5:
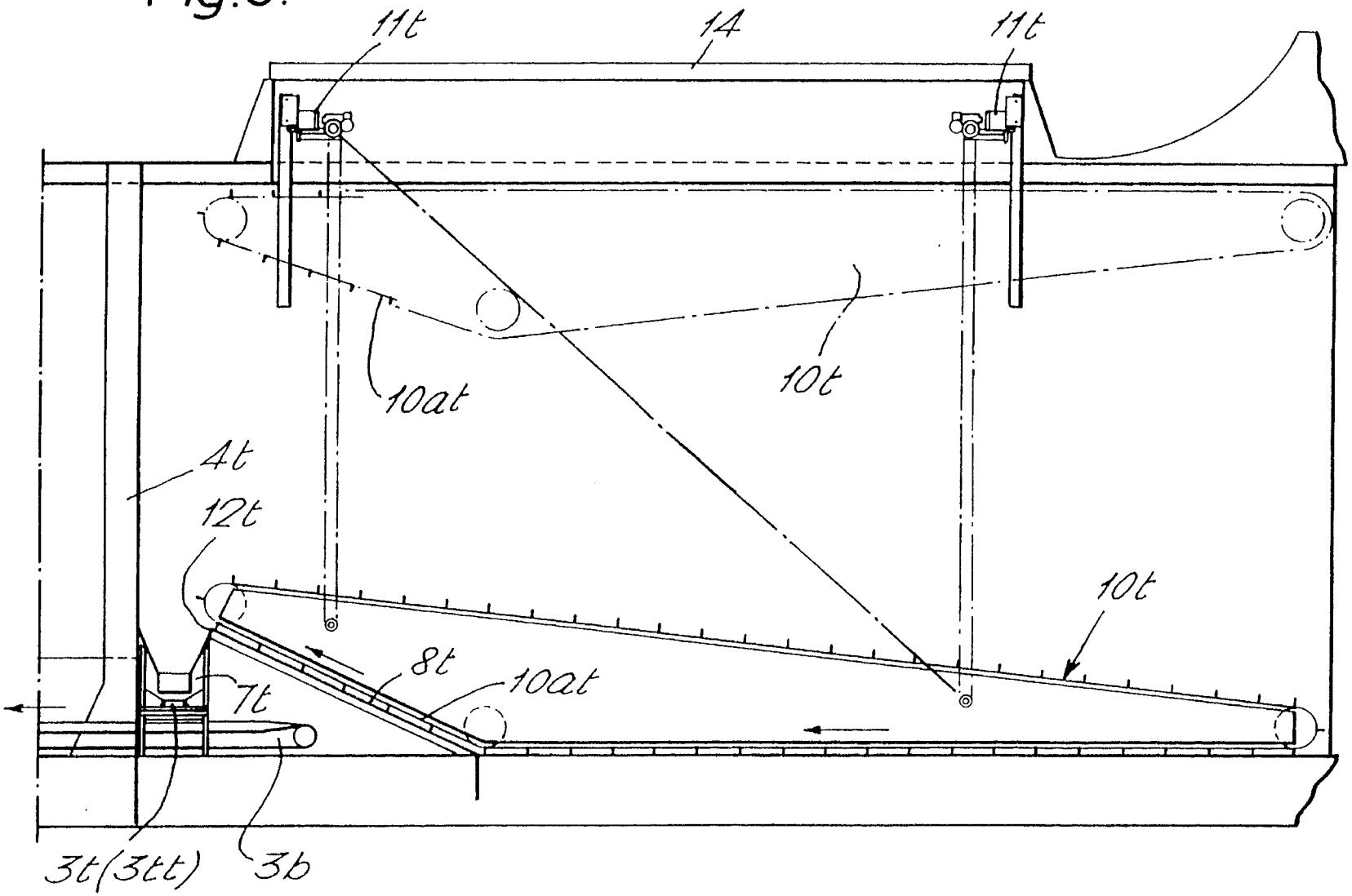
FIG. 5 is a longitudinal section taken along the line V—V in FIG. 1, and illustrates the scraper unit in an upper, parked position and a lower unloading position, respectively.

In FIGS. 3, 4 and 5 there is especially illustrated how the system according to the present invention can be implemented in the forward hold 2*a* of the ship or the aft hold 2*e* of the ship, there for the aft hold 2*e* of the ship being provided a longitudinally along the ship extending scraper unit which is generally designated by numeral 10*t*. In FIG. 5 there is illustrated the scraper unit 10*t* in a first lower scraping position drawn with solid lines, as well as an upper parked position drawn with dash-dotted lines. In the aft hold 2*e* there is also at least one bulk conveyor, here two conveyors 3*t* and 3*tt* which are provided transversly to the ship in the area of a transverse bulkhead 4*t*, said belt conveyor 3*t* residing in a transversly extending guiding path 7*t* having inclined guiding plates 8*t* only on that side which is facing away from the transverse bulkhead wall 4*t*, and having an overlying row of hoppers 12*t*. The scraper unit 10*t* which co-operates with the belt conveyors 3*t* and 3*tt* comprises only one lower bent portion 10*at* corresponding to the shape of the guiding plates 8*t*.

In FIGS. 3 and 4 it appears that the longitudinally extending scraper unit 10*t* is suspended in divided transversly to the ship extending driving beams 13*a*, 13*b* and 13*c*, the FIG. 3 illustrating the central driving beam 13*a* in a lower position, and coinciding with the associated side beams 13*b* and 13*c*. In FIG. 4 it is illustrated that the central driving beam 13*a* is in the upper position, i.e. just below the deck hatch 14 and a substantial distance above the permanently mounted side beams 13*b* and 13*c*.

Also here the scraper unit 10*t* is suspended in a traverser carriage having a winch 11*t*, and the central beam 13*a* is adapted to be displaced along an appropriate rail guiding 15 by means of a lifting screw 16.

By means of the divided running beams 13*a*, 13*b* and 13*c* the scraper unit 10*t* can be lifted up to right underneath the deck during unloading, as this appears from FIG. 4, or it can be lowered and transversly displaced underneath the side tanks 17 across the overall bottom width 9*b* of the aft hold 2*e* during the unloading operation, see FIG. 3.

It is to be understood that the transversly extending belt conveyors 3*t* and 3*tt* which receive masses from a respective longitudinally extending scraper unit 10*t* communicate with the longitudinally extending previously discussed belt conveyor 3*b*, which in turn brings the masses to the common outfeeding device.

Consequently, the present invention provides a system wherein the main components comprise a scraper unit in each hold, which from above scrapes or rakes masses towards a position from where the masses can avalanch into a tunnel or hopper, a set of inclined plates extending from the area of the hoppers and downwardly towards the hold bottom; such that the scraper units can entrain all mass up into the hoppers. Further, the system comprises a set of relatively narrow hoppers having an outfeed mechanism at the bottom for dosing the band conveyor or the band conveyors, as well as one or two transversly arranged band conveyors in the front and aft holds, if these,holds normally do not have parallel ship sides. Appropriately, the system comprises two longitudinally extending band conveyors at the center of the holds, said conveyors carrying masses from the transversly arranged band conveyors and/or from hoppers thereabove, towards one of the central transverse bulkheads of the ship. Further, there are provided two parallelly arranged cup conveyors—one on each side of said transverse bulkhead—which are adapted to lift the masses up to a common funnel where the masses finally are transferred to a closed, pivotable arm having an inner belt conveyor for unloading at shore.

The novel and specific advantages of the system can be summarized in the following points:

1. The combination of short, inclined plates and the bent scraper units enabling a combination of hopper feeding on a simple belt conveyor, a clean-scraped bottom as well as a low space consumption.
2. A very favourable coverage of the hold volume provided by the shape of the scraper unit and the associated beam structure.
3. The specific, divided driving beam which runs transversly to the ship, and which makes it possible to raise the longitudinally along the ship arranged scraper units quite up below the deck during loading, as well as driving the scraper units below the side tanks across the overall bottom width during unloading.

We claim:

1. An arrangement in an unloading system, especially for unloading bulk material (1*a*) from holds (2*a*–2*e*) in a transport vessel (1), comprising a belt conveyor (3*a*, 3*b*, 3*t*) extending substantially in the longitudinal direction of the vessel close to the flat bottom (9) thereof, said belt conveyor being arranged between the bottom (9), vertically extending supports (6) and downwardly extending guiding plates on each side of the conveyor (3*a*, 3*b*), a scraper unit (10) in each hold (2*a*, 2*e*) bringing bulk material (1*a*) to said conveyor (3*a*, 3*b*, 3*t*) as well as one or more lifting means co-operating with said belt conveyor (3*a*, 3*b*, 3*t*) for lifting said bulk material (1*a*) to a common outfeed device for bringing said material ashore, characterized in that the scraper unit (10) is adapted to be raised and lowered above the bottom of the vessel and moved longitudinally and transversely in relation thereto for aiding in a free avalanching or sliding of bulk material (1*a*) onto the belt conveyor (3*a*, 3*b*, 3*t*), and that the scraper unit (10) comprises a permanently bent lower portion comprising a first inner inclined area (10*s*) corresponding substantially to the inclination of the guiding plates (8) as well as a second outer substantially horizontal area (10*h*) which in a lower position of the scraper unit (10) may rest against the corresponding horizontal vessel bottom portion (9).

2. The arrangement as claimed in claim 1, characterized in that adjacent to the supports (6) along the belt conveyor (3*a*, 3*b*) there are provided a plurality of hoppers (12) serving to dose the bulk material (1*a*) from said scraper unit (10) and on to the belt conveyor (3*a*, 3*b*).

3. The arrangement as claimed in claim 1 or 2, characterized in that there are provided a first belt conveyor extending longitudinally along the vessel through a first number of holds (2*b*, 2*c*) towards a central transverse bulkhead (4*n*) of the vessel (1), as well as a second belt conveyor (3*b*) extending longitudinally along the vessel through a second number of holds (2*d*, 2*e*) towards said central transverse bulkhead (4*n*), and that at each side of the central transverse bulkhead (4) there are provided two parallelly arranged lifting means comprised of cup conveyors (5*a*, 5*b*) co-operating with a respective belt conveyor (3*a*, 3*b*) for lifting said bulk material up to the common outfeed device for bringing said bulk material ashore.

4. The arrangement as claimed in claim 3, characterized in that each of the two belt conveyors (3*a*, 3*b*) are arranged in a separate guiding path (7) which on each side of the two belt conveyors have guiding plates (8), and that the scraper units (10) which co-operate with said belt conveyors (3*a*, 3*b*), respectively, each comprises two lower bent portions (10*a*, 10*b*) which substantially symmetrically around the central axis of the guiding paths (7) correspond to the shape of the guiding plates (8) on each side of the guiding paths (7).

5. The arrangement as claimed in claim 1 or 2, characterized in that at an aft hold (2*e*) of the vessel or a front hold (2*a*) there is provided at least one transverse belt conveyor (3*t*) adjacent to a transverse bulkhead (4*t*), said belt conveyor (3*t*) residing in a guiding path (7*t*) having inclined guiding plates (8*t*) only on that side which is facing away from a transverse bulkhead wall (4*t*), and that a scraper unit (10*t*) co-operating with the belt conveyor (3*t*) extends in the longitudinal direction of the vessel and comprises only one lower bent portion (10*at*).

6. The arrangement as claimed in claim 5, characterized in that said longitudinally extending scraper unit (10*t*) is suspended in a divided driving beam (13*a*, 13*b*, 13*c*) extending transversely to the vessel which enables the scraper unit (10*t*) to be raised close to underneath the deck hatch (14) during loading (parked position), but can be lowered and displaced transversely below the side tanks (17) across the overall bottom width (9*b*) of the hold (2*e*) during unloading.

7. The arrangement as claimed in claim 5, characterized in that there are provided two transversely extending belt conveyors (3*t*, 3*tt*) receiving bulk material from the longitudinal extending scraper unit (10*t*), said two transversely extending belt conveyors (3*t*, 3*tt*) communicating with a longitudinally extending belt conveyor (3*b*) which on each side conveys said material to the common outfeed device.

8. The arrangement as claimed in claim 6, characterized in that there are provided two transversely extending belt conveyors (3*t*, 3*tt*) receiving bulk material from the longitudinal extending scraper unit (10*t*), said two transversely extending belt conveyors (3*t*, 3*tt*) communicating with a longitudinally extending belt conveyor (3*b*) which on each side conveys said material to the common outfeed device.

* * * * *